United States Patent [19]

Burton

[11] 4,132,184

[45] Jan. 2, 1979

[54] SHEET MATERIAL GUIDANCE SYSTEM

[76] Inventor: Perry E. Burton, P.O. Box 68, Fountain Inn, S.C. 29644

[21] Appl. No.: 799,287

[22] Filed: May 23, 1977

[51] Int. Cl.[2] ..... D05B 21/00; D05B 35/10

[52] U.S. Cl. ..... 112/262; 112/121.26; 112/153; 112/147; 26/75; 226/44

[58] Field of Search ..... 112/262, 153, 136, 152, 112/208, 210, 203, 214, 121.26, 121.12, 121.11, 147, 141, 143, 121.27; 26/75, 51.5; 226/20, 21, 44, 198

[56] References Cited

U.S. PATENT DOCUMENTS

| | | | |
|---|---|---|---|
| 2,544,467 | 3/1951 | Michel | 226/44 X |
| 2,618,230 | 11/1952 | Pons | 112/214 X |
| 2,722,415 | 11/1955 | Wood, Jr. | 26/75 X |
| 2,747,866 | 5/1956 | Schmidt | 226/44 |
| 2,842,361 | 7/1958 | Miller | 226/21 |
| 2,907,291 | 10/1959 | Schrader | 112/214 X |
| 3,054,547 | 9/1962 | Alexeff et al. | 226/198 |
| 3,463,482 | 8/1969 | Baron et al. | 112/147 X |
| 3,581,963 | 6/1971 | Rule | 226/21 X |
| 3,610,493 | 10/1971 | Brocklehurst | 26/75 X |
| 3,807,613 | 4/1974 | Holm | 226/44 |

*Primary Examiner*—H. Hampton Hunter
*Attorney, Agent, or Firm*—Jones, Thomas & Askew

[57] ABSTRACT

The guidance system pulls sheet material along its length from a supply and moves the sheet material across a work table through a sewing machine and the like. The sheet material extends through a loop and is moved from a level displaced from the level of the work surface of the work table about a horizontal guide bar and then onto the work table. An edge detector senses the edge of the sheet material, and the guide bar is pivoted about an upwardly extending axis in response to the drifting of the edge of the sheet material away from the desired predetermined path of movement toward the sewing machine to guide the edge of the material back to its desired path. The edge portion of the sheet material is carried by bands and tapes movable along the work surface of the work table, up an incline to the bed of the sewing machine, and the edge of the sheet material is folded as it moves up the incline to the sewing machine needle, and the folded and sewn hem of the sheet material leaving the needle of the sewing machine is pulled at a faster rate than the main body of the sheet material along the work table.

4 Claims, 5 Drawing Figures

SHEET MATERIAL GUIDANCE SYSTEM

BACKGROUND OF THE INVENTION

This invention relates to a guidance system of the type that can be used in conjunction with a sewing machine, where an edge portion of continuous sheet material, such as terry cloth, can be folded over and sewn to form a hem in the sheet material.

While various guidance systems have been developed in the past for the purpose of expediently and accurately moving sheet material to a sewing machine, and wherein the edge portion of the sheet material is folded to form a hem which is sewn closed by the sewing machine, most of the prior art systems have been somewhat complicated and have not functioned quickly, accurately and reliably to make adjustments for variations in the sheet material. Also, the hems formed by the prior art systems sometimes are improperly formed because of improper guidance of the edge of the cloth material through the folder and sewing machine and because the friction between the cloth and the folder causes the cloth to creep out of the folder. In some instances, the sheet materail being processed through a system will have wavy or curled edges that require the processing system to continuously and rapidly adjust the position of the sheet material with respect to the folder and sewing machine so that a continuous, properly formed folded hem is formed by the system. Moreover, additional or more precise guidance is required in systems which guide material through folders to prevent the frictional drag of the folder against the material from causing the edge portion of the material from drifting out of the folder or away from the needle of the sewing machine.

SUMMARY OF THE INVENTION

Briefly described, the present invention comprises a sheet material guidance system for a sewing machine and the like wherein a continuous sheet or web of material is pulled from a supply and moved onto the work surface of a work table where a sewing machine sews through the material. The sheet material moves along its length through a loop at a level displaced from the level of the work surface, and then about a guide bar and onto the work surface. The edge portion of the sheet material moves through a folder as the sheet material approaches the sewing machine, and the sewing machine sews the fold closed to form a hem. An edge detector detects the presence and absence of the edge of the sheet material as the edge moves along a predetermined path toward the sewing machine, and the guide bar is pivoted about an upwardly extending axis spaced from the guide bar rearwardly along the path of movement of the sheet material in response to the detection of the presence or absence of the edge of the sheet material to rapidly shift the sheet material and progressively guide the sheet material so that its edge returns to the predetermined path. Constant tension is applied to the sheet material as it passes through its loop and toward the guide bar so that the pivoting of the guide bar is effective to shift the sheet material as desired, and as the length of the sheet material in the loop increases or decreases, the rate of feeding of the sheet material to the loop proportionally decreases or increases, to maintain a substantially constant length of sheet material in the loop and to maintain substantially constant tension in the sheet material in the loop throughout the operation of the system.

Thus, it is an object of this invention to provide a guidance system for a sewing machine and the like wherein sheet material is accurately guided along a predetermined path from a supply toward a sewing machine, where the edge portion of the sheet material can be folded and sewn to form a neat hem in the sheet material.

Another object of this invention is to provide an inexpensive and reliable guidance system which can be used in combination with a folding and sewing system, and which accurately guides the edge of sheet material to such a system.

Another object of this invention is to provide a hem folding and sewing apparatus with a guidance system which accurately and reliably moves sheet material along a predetermined path into and through the folding and sewing apparatus.

Other objects, features and advantages of this invention will becomes apparent upon reading the following specification, when taken in conjunction wth the accompanying drawings.

DETAILED DESCRIPTION

Figure 1:
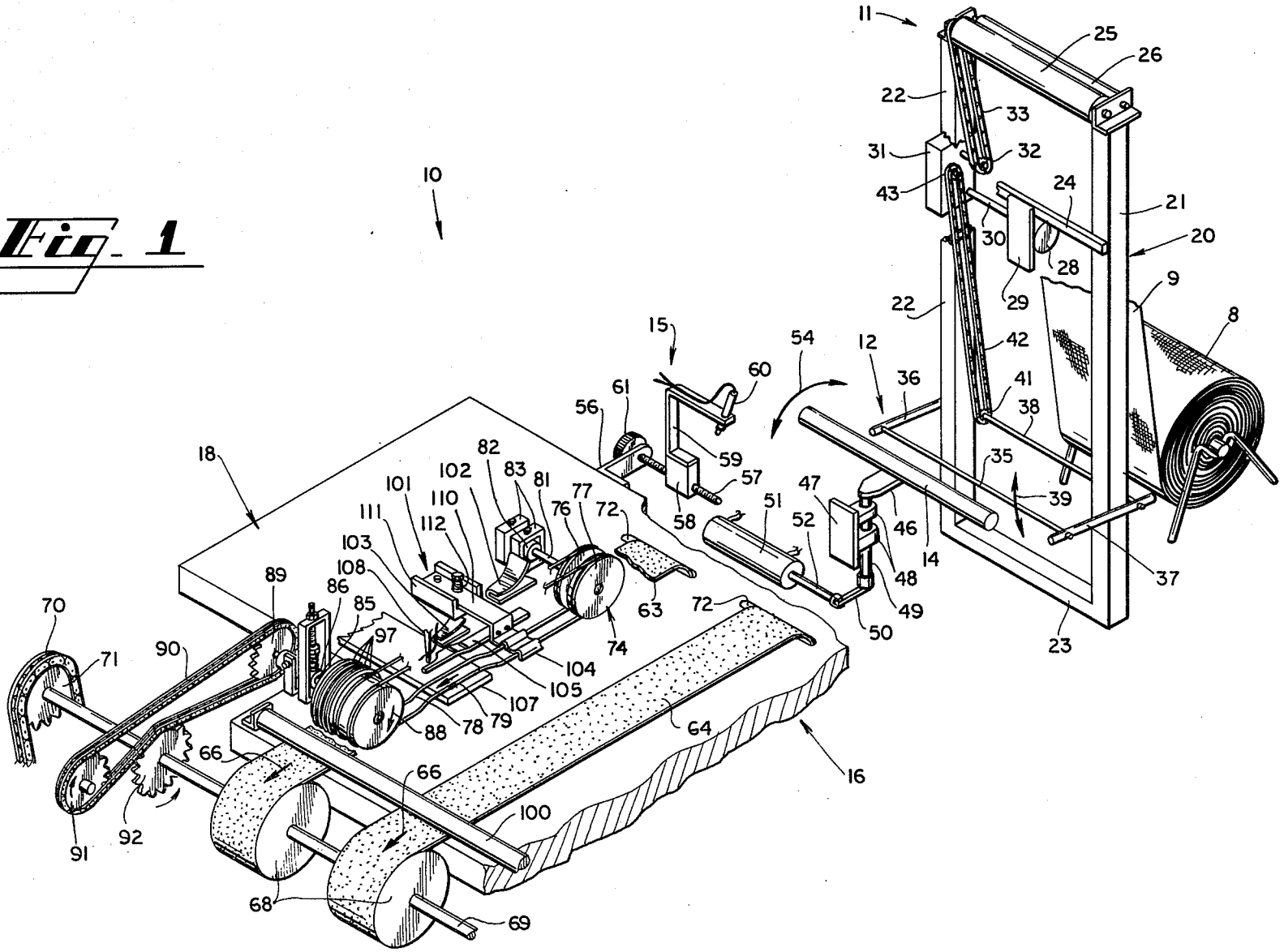
FIG. 1 is a schematic perspective illustration of the guidance system for a sewing machine.

Referring now in more detail to the drawings, in which like numerals indicate like parts throughout the several views, FIG. 1 illustrates the guidance system 10 for sewing machines, which includes feed means 11, tension means 12, guide bar 14, edge detector 15, work table 16, and transport means 18. Feed means 11 includes framework 20 with upright legs 21 and 22, bottom brace 23 and crossbar 24. Sheet driving roll 25 is mounted at its ends in bearings at the upper portions of upright legs 21 and 22, and idler roll 26 is spring-biased toward contact with the driving roll 25. Electric motor 28 is mounted on support plate 29 which is suspended from the crossbar 24, and driving shaft 30 from motor 28 extends into the variable speed transmission 31. The output shaft and sprocket 32 of the variable speed transmission 31 are connected by continuous roller chain 33 to a sprocket (not shown) as the end of sheet driving roll 25, so that the operation of electric motor 28 causes the sheet driving roll 25 to rotate.

Tension means 12 comprises tension bar 35 connected at its ends to side bars 36 and 37, and side bars 36 and 37 are each rigidly connected to pivot bar 38. Pivot bar 38 is hingedly mounted to the back side of upright legs 21 and 22 of frame 20 of the feed means 11, so that the tension bar 35 is movable up and down through an arc 39 and is urged downwardly by gravity. Sprocket 41 is rigidly mounted on pivot bar 38, and continuous roller chain 42 extends about sprocket 41 and about another sprocket 43 on the variable drive transmission 31. The variable drive transmission 31 is a "zero-max" transmission, and when sprocket 43 is rotated, the speed of the continuous chain 33 which causes the sheet driving roll 25 to rotate is varied. Thus, when the tension bar 35 moves in a downward arc under its own weight, its chain 42 will rotate the sprocket 43 of the variable speed transmission 31, causing the drive chain 33 from the transmission to reduce speed a proportionate amount, so that the rotation of the sheet driving roll 25 is also reduced until the sheet driving roll completely stops; however, should the tension bar 35 move through an upward arc and rotate the sprocket 43 of the variable speed transmission 31 in the opposite direction, the speed of rotation of the sheet driving roll 25 would progressively increase.

Guide bar 14 comprsies a rectilinear bar which is mounted on a support plate 46. Mounting plate 47 is mounted on the frame of work table 16 and supports bearings 48. Pivot pin 49 extends upwardly through the bearings 48 and is connected to the support plate 46 at its upper end, and crank lever 50 is connected to the lower end of the pivot pin 49. Fluid actuated ram 51 is also supported on the framework of the support table 16 and its shaft 52 is connected at its end to the other end of crank lever 50. When the ram 51 is actuated to distend or retract its rod 52, the crank arm 50 and pivot pin 49 of the guide bar assembly cause the guide bar 14 to pivot as indicated by arrows 54 about the upwardly extending pivot pin 49.

Edge detector 15 is also mounted on the work table frame by bracket 56. A travel screw 57 is held by the bracket 56 in a horizontal attitude, and a travel block 58 is threadedly held on the travel screw 57. Photocell bracket 59 is mounted on the travel block 58 and the photoelectric cell 60 is supported by the bracket 59. When the travel screw 57 is rotated by the operator turning the knob 61, the travel block 58 will move along the length of the travel screw 57, so that the photoelectric cell 60 is shifted either to the left or to the right with respect to the guidance system.

Transport means 18 is mounted on work table 16 and includes one or more continuous conveyor tapes 63 and 64, with each conveyor tape having an upper run that extends across the upper or work surface 65 of the work table 16 in the direction indicated by arrow 66. Conveyor drive rollers 68 are mounted on a common drive shaft 69. A motor and a variable speed transmission (not shown) drive the continuous roller chain 70 which is mounted on the sprocket 71 at the end of drive shaft 69 to drive the conveyor tapes 63 and 64. The conveyor tapes 63 and 64 can be driven across the entire work table 16 or can emerge up through openings in the work table, such as up through opening 72 for conveyor tape 63.

Transport means 18 also includes band guide system 74 which includes guide roller 75 at one end and a pair of spaced guide sheaves 76 and 77 at the other end, and continuous bands 78 and 79 which extend about the roller 75 and sheaves 76 and 77. Sheaves 76 and 77 are mounted on rotatable axle 81, and axle 81 is mounted in bearing 82 which is supported by brackets 83. Roller 75 is also mounted on axle 85 in bearing 86, and the bearing 86 is mounted in spring-loaded bracket 87. The axle 85 of roller 75 is driven in the direction indicated by arrow 88 by drive sprocket 89, continuous chain 90, idler sprocket 91, and drive shaft sprocket 92.

Figure 5:
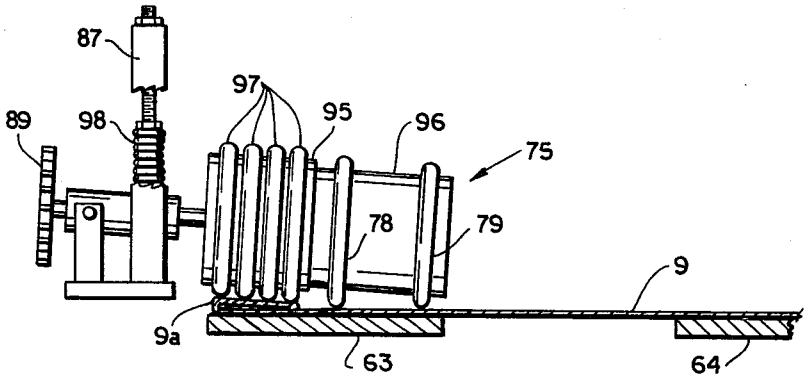
FIG. 5 is a detail illustration of the band roller assembly.

As illustrated in FIG. 5, the roller 75 includes a large diameter portion 95 and a small diameter portion 96, and the bands 78 and 79 are received in grooves (not shown) in the small diameter portion 96. A plurality of elastic rings or bands 97 are received in grooves (not shown) in the large diameter portion 95 of the roller 75. The roller 75 is mounted over conveyor tape 63, and the roller is spring-urged by the compression spring 98 in bracket 87 down toward contact with the continuous sheet material 9 and the conveyor tape 63. The number of teeth on the driving sprockets 71, 89, 91 and 92, and the diameter of the smaller diameter portion 96 of the roller 75 are all calibrated so that the rotation of the roller 75 causes the continuous bands 78 and 79 to move at the same velocity as the conveyor tape 63. Since the rings or bands 97 on the larger diameter portion 95 of the roller 75 move at the same angular velocity as the bands 78 and 79 move about the roller 75, the larger diameter of the bands 97 results in the bands 97 moving at a faster surface velocity than the bands 78 and 79. The bands 97 are located over the folded and sewn hem **9*a*** of the sheet material.

Idler roller 100 is rotatably mounted at the trailing edge of the work table 16 and is rotated by the movement of the conveyor tapes 63 and 64 and the sheet material 9 carried thereby beneath the roller.

Folder assembly 101 comprises a first stationary folder 102 mounted on the work surface 65 of the work table 16, a second stationary folder 103 positioned downstream from the first folder 102, band hold-down plate 104, and presser foot 105. The bed 107 of the sewing machine is mounted in the work table 16 so that its upper surface is raised above the work surface 65 of the work table. The second folder 103 is mounted so that its folding surfaces are raised with respect to the work surface 65, so that it feeds a folded hem to the needle 108 of the sewing machine at the level of the sewing machine bed 107.

Hold-down plate 104 and presser foot 105 are both mounted on bracket 110 which extends over the stationary folders 102 and 103, and bracket 110 is mounted in bracket mount 111. The coil compression spring 112 of bracket mount 111 continuously biases the bracket 110 in a downward direction so that the hold-down plate 104 and presser foot 105 are continuously urged toward the sheet material that is guided through the system.

OPERATION

Figure 2:
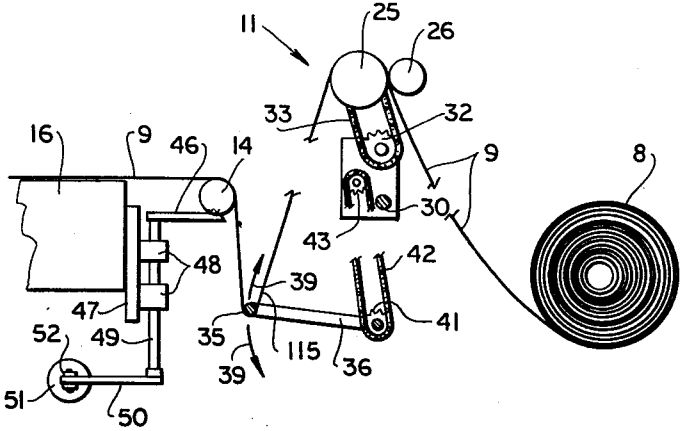
FIG. 2 is a schematic side elevational view, with portions removed, of the portion of the guidance system in front of the work table.

When the guidance system for a sewing machine is put into operation, sheet material 9 from a source of supply such as reel 8 is threaded between the sheet driving roll 25 and its idler roll 26, and the driving roll 25 then functions to pull the sheet material 9 along its length from its supply into the system. The sheet material is fed from the driving roll 25 in a downward direction through a loop 115 (FIG. 2), beneath the tension bar 35, and then upwardly over the guide bar 14 and onto the work table 16. The tension bar is urged downwardly by gravity into the loop of sheet material, and when the tension bar 35 moves upwardly or downwardly as indicated by the arrows 39, it rotates its sprocket 41 which causes a corresponding movement of continuous chain 42 and of variable speed transmission sprocket 43, causing a change in the output speed of continuous chain 33 to sheet driving roll 25. For example, when the feed means 11 is feeding sheet material faster than the sewing machine is accepting the sheet material, the loop 115 of sheet material between the sheet driving roll 25 and the guide bar 14 will increase in size so that the tension bar 35 willl move in a downward arc. The downward arcuate movement of the tension bar causes the variable speed transmission 31 to decrease the speed of rotation of the sheet driving roll so that the sewing machine can catch up with its supply. Of course, as the supply of sheet material in the loop is depleted, the tension bar 35 begins to move in an upwrd direction and the speed of rotation of the sheet driving roll 25 is decreased.

Figure 3:
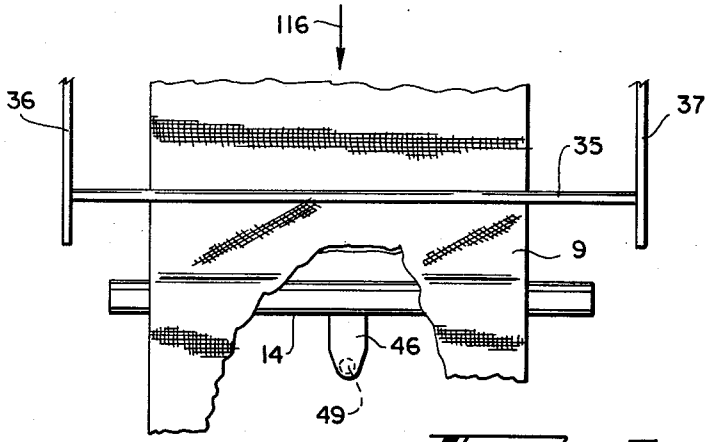
FIGS. 3 and 4 are partial top views of the guide bar and tension bar, illustrating the manner in which the guide bar shifts the sheet material.
Figure 4:
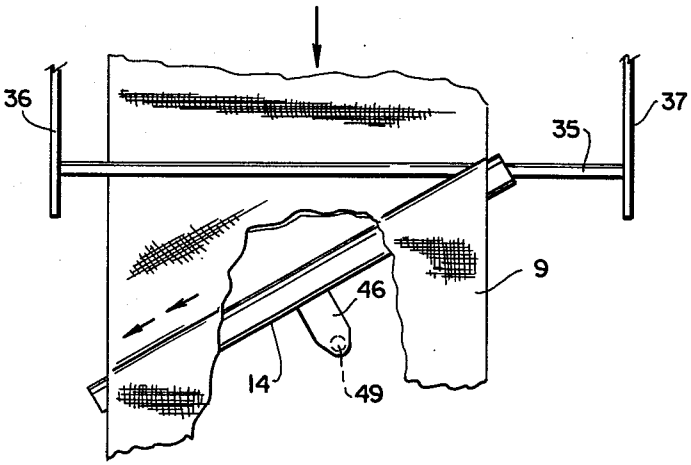

When the sheet material 9 moves upwardly from the tension bar 35, it passes over the guide bar 14 and then moves onto the work table 16. The photoelectric cell 60 (FIG. 1) of the edge detector 15 detects the presence and absence of the edge of the sheet material as it moves across the work table, through the folders 102 and 103 and into the sewing machine. When the photoelectric cell 60 detects the absence of the edge of the sheet material, its control system (not shown) actuates fluid actuated ram 51 so as to distend or retract its rod 52 and pivot crank arm 50 and pivot pin 49 of the guide bar 14, so that the guide bar 14 is rotated about the pivot pin 49. While only one photocell is illustrated in the drawing, it will be understood by those skilled in the art that two or more photocells which straddle the desired path for the edge of the sheet material can be used to detect the movements of the edge of the sheet out of the path. As illustrated in FIGS. 3 and 4, the guide bar 14 is a rectilinear bar and is normally maintained at right angles with respect to the direction of movement 116 of the sheet material 9. Since the guide bar 14 is offset forwardly from its pivot pin 49, the guide bar 14 will shift to some extent to one side of the pivot pin 49 when it is rotated about the pivot pin. In FIG. 4, the guide bar is shown when it has been rotated in a counterclockwisee direction, and its counterclockwise rotation causes the sheet material 9 to shift to the left with the rotation of the guide bar. In addition, the tension bar 35 applies a substantially constant amount of tension to the sheet material as it moves in an upward direction over the guide bar 14 because of the weight of the tension bar bearing into the loop of material so that the sheet material 9 tends to walk or slide over the surface of the guide bar 14 further to the left (FIG. 4) because of the angle of the guide bar with respect to the tension bar. When the sheet material 9 has shifted far enough to the left so that the edge detector 15 is satisfied that the edge of the sheet material is back in its predetermined path of movement toward the folders 102 and 103 and the needle 108 of the sewing machine, the cylinder 51 will pivot the guide bar back to its position as illustrated in FIG. 3, so that the sheet material will continue to track along the desired path. Of course, if the edge detector 15 should detect that the edge portion of the sheet material is moved too far into the folders and sewing machine, it will function to rotate the guide bar 14 in a clockwise direction, where the sheet material will be shifted to the right and the tension applied to the sheet material as it passes over the upper portion of the guide bar will continue to cause the sheet material to walk to the right.

The transport means 18 grips the sheet material between the bands 78 and 79 which come down against the top surface of the sheet material and the conveyor tape 63 which moves across the work surface 65 beneath the sheet material so as to positively control the sheet material as it approaches the folders 102 and 103. If additional conveyor tapes 64 are used in the system, these additional conveyor tapes will assist the body portion of the sheet material to move on across work table 16, and the idler roller 100 at the trailing edge of the work table 16 tends to press the top of the sheet material down against the moving conveyor tapes so as to control the sheet material as it moves off the work table. The continuous bands 78 and 79 move from beneath sheaves 76 and 77 beneath the hold-down plate 104, and the portion of the bands extending between the sheaves and the hold-down plate are positively urged against the sheet material and against the moving conveyor tape 63 to form a firm grip on the sheet material and to positively urge the sheet material on through the system. When the bands emerge from the hold-down plate 104, the bands and tape 63 move up an incline to the raised sewing machine bed 107, across the sewing machine bed, and then move back down an incline to the work surface 65 of the work table 16. The first folder 102 forms the first fold in the edge portion of the sheet material, and the second folder 103 receives a first fold and then folds the first fold over on itself again to form a second fold. The second folder 103 is raised to the level of the bed 107 of the sewing machine and functions to fold the edge portion of the sheet material as the sheet material moves up the incline from the hold-down plate 104 to the bed 107 of the sewing machine. The presser foot 105 coacts with the stationary folder 103 to help control the edge portion of the sheet material as it is being passed through the folders, so as to form a perfect fold in the sheet material.

When the sheet material passes beneath the needle 108 of the sewing machine, the folded portion of the sheet material will be sewn closed by the needle. The now-hemmed sheet material continues to move with the transport means 18 beyond the needle 108 of the sewing machine, and the hem **9*a* passes beneath the rings or bands 97 of the roller 75 (FIG. 5). Since the bands 97 move at a faster surface velocity than the bands 78 and 79, the hem is urged at a faster rate on through the system, causing the sheet material to tend to cant or twist slightly on the work table 16 into the folders and sewing machine. Thus, the friction applied to the edge portion of the sheet material by the folders 102 and 103 is overcome by the larger diameter portion 95 of the roller 75 and its band 97. Therefore, the tendency of the sheet material to migrate out of the folders 102 and 103 because of the friction applied to the sheet material by the folders is overcome by the tendency of the larger diameter portion 95 of the roller 75** to pull or cant the sheet material into the folders.

While this invention has been described in detail with particular reference to preferred embodiments thereof, it will be understood that variations and modifications can be effected within the spirit and scope of the invention as described hereinbefore and as defined in the appended claims.

I claim:

1. A method of guiding a length of sheet material to a sewing machine and the like comprising pulling the sheet material along its length from a supply and feeding the sheet material through a loop first in a downward direction beneath a movable tension bar and then in an upward direction, supporting the tension bar with the sheet material as the sheet material passes through the loop to apply substantially constant tension in the sheet material as the sheet material moves upwardly away from the tension bar, decreasing the rate at which the sheet material is pulled from its supply in response to a downward movement of the tension bar and increasing the rate at which the sheet material is pulled in response to an upward movement of the tension bar, feeding the sheet material over a guide bar from the upper portion of the loop over a work table into a sewing machine, detecting the position of the edge of the sheet material as the sheet material moves from the guide bar to the sewing machine, pivoting the guide bar about an upwardly extending axis located along the direction of movement of the sheet material from the guide bar in response to detecting the movement of the edge of the sheet material away from a desired path of movement, folding an edge of the sheet material over as the sheet material approaches the sewing machine, and pulling the sheet material on and adjacent its hem through the sewing machine with most of the pulling forces being applied to the hem and extending rearwardly through the material adjacent the edge being hemmed whereby the edge of the sheet material is urged into the desired position for folding.

2. The method of claim 1 and wherein the step of pulling the sheet material into a sewing machine comprises moving a conveyor tape over the surface of the work table past a sewing machine, guiding at least one continuous band toward engagement with the conveyor tape and sheet material and pulling the sheet material with the band and conveyor tape over the bed of the sewing machine.

3. The method of claim 1 and wherein the step of pulling the sheet material into a sewing machine comprises urging the sheet material at a predetermined rate across the work table and urging the hem of the sheet material at a faster rate than the predetermined rate across the work table.

4. The method of claim 1 and wherein the stop of pulling the sheet material into a sewing machine comprises urging the edge portion of the sheet material from the level of the work table over the bed of a sewing machine at a higher level than the work table, and folding the edge portion of the sheet material as it moves from the lower level of the work table to the higher level of the bed of the sewing machine.

* * * * *